US010077736B2

(12) United States Patent
Nishio et al.

(10) Patent No.: US 10,077,736 B2
(45) Date of Patent: Sep. 18, 2018

(54) HEAT RETENTION MEMBER FOR CYLINDER BORE WALL, INTERNAL COMBUSTION ENGINE, AND AUTOMOBILE

(71) Applicant: NICHIAS CORPORATION, Tokyo (JP)

(72) Inventors: Kazuaki Nishio, Shizuoka (JP); Akihiro Yoshimura, Shizuoka (JP)

(73) Assignee: NICHIAS CORPORATION, Tokyo (JP)

( * ) Notice: Subject to any disclaimer, the term of this patent is extended or adjusted under 35 U.S.C. 154(b) by 26 days.

(21) Appl. No.: 14/710,246

(22) Filed: May 12, 2015

(65) Prior Publication Data

US 2015/0240743 A1 Aug. 27, 2015

Related U.S. Application Data

(62) Division of application No. 13/806,417, filed as application No. PCT/JP2011/063049 on Jun. 7, 2011, now Pat. No. 9,032,916.

(30) Foreign Application Priority Data

Jun. 22, 2010 (JP) ..... 2010-141285

(51) Int. Cl.
*F02F 1/16* (2006.01)
*F01P 3/02* (2006.01)
(Continued)

(52) U.S. Cl.
CPC *F02F 1/16* (2013.01); *F01P 3/02* (2013.01); *F02F 1/10* (2013.01); *F02F 1/14* (2013.01); *F01P 2003/021* (2013.01)

(58) Field of Classification Search
CPC ..... F02F 1/14; F02F 1/10; F02F 1/004; F02F 2001/104; F02F 2001/106; F02F 1/065; F01P 2003/021; F01P 7/14; F02B 77/11
(Continued)

(56) References Cited

U.S. PATENT DOCUMENTS 2,127,825 A * 8/1938 Mader ..... F02F 1/186 123/193.3
3,834,625 A * 9/1974 Barthod-Malat ..... B05B 3/02 239/214
(Continued)

FOREIGN PATENT DOCUMENTS

JP 2005-120949 A 5/2005
JP 2007-071039 A 3/2007
(Continued)

OTHER PUBLICATIONS

International Search Report for PCT/JP2011/063049, dated Aug. 16, 2011.
(Continued)

*Primary Examiner* — Long T Tran
(74) *Attorney, Agent, or Firm* — Westerman, Hattori, Daniels & Adrian, LLP

(57) ABSTRACT

A cylinder bore wall insulating member has a contact surface that comes in contact with a wall surface of a cylinder bore wall that forms a cylinder block of an internal combustion engine and defines a groove-like coolant passage. An internal combustion engine in which the cylinder bore wall has a uniform temperature may be obtained using the insulating member.

17 Claims, 6 Drawing Sheets

(51) Int. Cl.
*F02F 1/10* (2006.01)
*F02F 1/14* (2006.01)

(58) Field of Classification Search
USPC ..... 123/41.79
See application file for complete search history.

(56) References Cited

U.S. PATENT DOCUMENTS

| | | | | |
|---|---|---|---|---|
| 5,542,381 | A | 8/1996 | Noda et al. | |
| 5,890,719 | A | 4/1999 | Bettencourt | |
| 6,517,084 | B2 * | 2/2003 | Inamura | F16J 15/0818 277/591 |
| 6,834,625 | B2 * | 12/2004 | Matsutani | F01P 3/02 123/41.72 |
| 6,874,451 | B2 * | 4/2005 | Matsutani | F01P 3/02 123/41.79 |
| 7,032,547 | B2 | 4/2006 | Xin | |
| 7,287,757 | B2 | 10/2007 | Chen et al. | |
| 8,091,518 | B2 | 1/2012 | Shikida et al. | |
| 2003/0230253 | A1 * | 12/2003 | Matsutani | F01P 3/02 123/41.74 |
| 2003/0230254 | A1 * | 12/2003 | Matsutani | F01P 3/02 123/41.79 |
| 2005/0235930 | A1 | 10/2005 | Xin | |
| 2009/0031978 | A1 * | 2/2009 | Kobayashi | F01P 3/02 123/142.5 R |
| 2009/0126667 | A1 * | 5/2009 | Shikida | B60H 1/00492 123/142.5 R |
| 2009/0194046 | A1 | 8/2009 | Shikida et al. | |
| 2009/0277411 | A1 * | 11/2009 | Hamaguchi | F01P 11/20 123/179.21 |
| 2010/0031902 | A1 | 2/2010 | Alyanak et al. | |
| 2011/0114041 | A1 * | 5/2011 | Hamakawa | F02F 1/14 123/41.72 |
| 2011/0114043 | A1 | 5/2011 | Hamakawa et al. | |
| 2012/0132157 | A1 * | 5/2012 | Matsuki | F02F 1/14 123/41.79 |

FOREIGN PATENT DOCUMENTS

| | | | |
|---|---|---|---|
| JP | 2007-162473 | A | 6/2007 |
| JP | 2007-309221 | A | 11/2007 |
| JP | 2008-031939 | A | 2/2008 |
| WO | 2008/016127 | A1 | 2/2008 |

OTHER PUBLICATIONS

Office Action dated Apr. 3, 2014, issued in corresponding Chinese Patent Application No. 201180025389.X with English translation (10 pages).

Office Action dated Jun. 4, 2014, issued in Corresponding Japanese Patent Application No. 2010-141285, with English Translation (9 pages).

Office Action dated Dec. 21, 2016, issued in counterpart European Application No. 11 797 982.3. (5 pages).

* cited by examiner (4－1)

(4－2)

(4－3)

(5－1)

(5－2)

(7－1)

(7－2)

HEAT RETENTION MEMBER FOR CYLINDER BORE WALL, INTERNAL COMBUSTION ENGINE, AND AUTOMOBILE

This application is a divisional of U.S. application Ser. No. 13/806,417 filed Mar. 11, 2013, which is a 371 of PCT/JP2011/063049 filed Jun. 7, 2011, and claims priority to Japanese Patent Application No. 2010-141285 filed Jun. 22, 2010, the entire disclosures of which applications are incorporated herein by reference.

TECHNICAL FIELD

The invention relates to a cylinder bore wall insulating member that is disposed to come in contact with the wall surface of a cylinder bore wall that forms a cylinder block of an internal combustion engine and defines a groove-like coolant passage, an internal combustion engine that includes the cylinder bore wall insulating member, and an automobile that includes the internal combustion engine.

BACKGROUND ART

An internal combustion engine is designed so that fuel explodes within the cylinder bore when the piston is positioned at top dead center, and the piston is moved downward due to the explosion. Therefore, an upper area of the cylinder bore wall increases in temperature as compared with a lower area of the cylinder bore wall. Accordingly, a difference in the amount of thermal deformation occurs between the upper area and the lower area of the cylinder bore wall (i.e., the upper area of the cylinder bore wall expands to a large extent as compared with the lower area of the cylinder bore wall).

As a result, the frictional resistance of the piston against the cylinder bore wall increases, so that the fuel consumption increases. Therefore, a reduction in difference in the amount of thermal deformation between the upper area and the lower area of the cylinder bore wall has been desired.

Attempts have been made to control the cooling efficiency in the upper area and the lower area of the cylinder bore wall due to the coolant by disposing a spacer in a groove-like coolant passage to adjust the flow of the coolant in the groove-like coolant passage so that the cylinder bore wall has a uniform temperature. For example, Patent Document 1 discloses an internal combustion engine heating medium passage partition member that is disposed in a groove-like heating medium passage formed in a cylinder block of an internal combustion engine to divide the groove-like heating medium passage into a plurality of passages, the heating medium passage partition member including a passage division member that is formed at a height above the bottom of the groove-like heating medium passage, and serves as a wall that divides the groove-like heating medium passage into a bore-side passage and a non-bore-side passage, and a flexible lip member that is formed from the passage division member in the opening direction of the groove-like heating medium passage, the edge area of the flexible lip member being formed of a flexible material to extend beyond the inner surface of one of the groove-like heating medium passages, the edge area of the flexible lip member coming in contact with the inner surface at a middle position of the groove-like heating medium passage in the depth direction due to the flexure restoring force after insertion into the groove-like heating medium passage to separate the bore-side passage and the non-bore-side passage.

RELATED-ART DOCUMENT

Patent Document

Patent Document 1: JP-A-2008-31939 (claims)

SUMMARY OF THE INVENTION

Technical Problem

According to the internal combustion engine heating medium passage partition member disclosed in Patent Document 1, since the temperature of the cylinder bore wall can be made uniform to a certain extent, the difference in the amount of thermal deformation between the upper area and the lower area of the cylinder bore wall can be reduced. However, a further reduction in the difference in the amount of thermal deformation between the upper area and the lower area of the cylinder bore wall has been desired.

An object of the invention is to provide an internal combustion engine in which the cylinder bore wall has a uniform temperature.

Solution to Problem

The inventors of the invention conducted extensive studies in order to solve the above technical problem, and found that the temperature of the cylinder bore wall can be made uniform by disposing a cylinder bore wall insulating member to come in contact with the cylinder bore wall that defines a groove-like coolant passage and prevent a situation in which a coolant comes in direct contact with the cylinder bore wall. This finding has led to the completion of the invention.

According to a first aspect of the invention, a cylinder bore wall insulating member has a contact surface that comes in contact with a wall surface of a cylinder bore wall that forms a cylinder block of an internal combustion engine and defines a groove-like coolant passage.

According to a second aspect of the invention, a internal combustion engine includes a cylinder bore wall insulating member that has a contact surface that comes in contact with a wall surface of a cylinder bore wall that forms a cylinder block of the internal combustion engine and defines a groove-like coolant passage, the cylinder bore wall insulating member being disposed so that the contact surface comes in contact with the wall surface of the cylinder bore wall that defines the groove-like coolant passage.

According to a third aspect of the invention, an automobile includes the internal combustion engine according to the second aspect of the invention.

Advantageous Effects of the Invention

The invention thus ensures that the cylinder bore wall of an internal combustion engine has a uniform temperature. This makes it possible to reduce the difference in the amount of thermal deformation between the upper area and the lower area of the cylinder bore wall.

DESCRIPTION OF EMBODIMENTS

Figure 1:
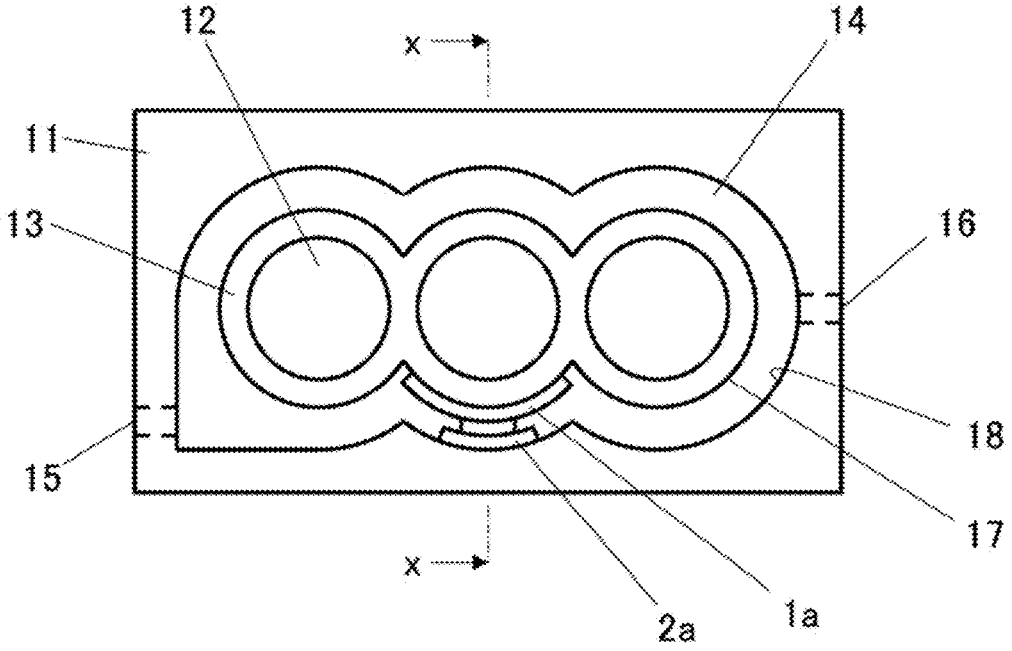
FIG. 1 is a schematic plan view illustrating a state in which a cylinder bore wall insulating member according to one embodiment of the invention is disposed in a cylinder block.
Figure 2:
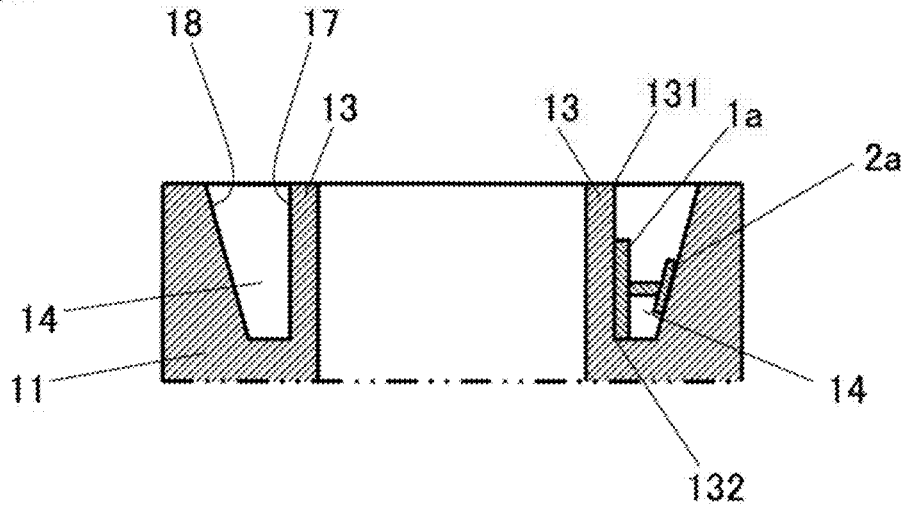
FIG. 2 is a cross-sectional view taken along the line x-x in FIG. 1.
Figure 3:
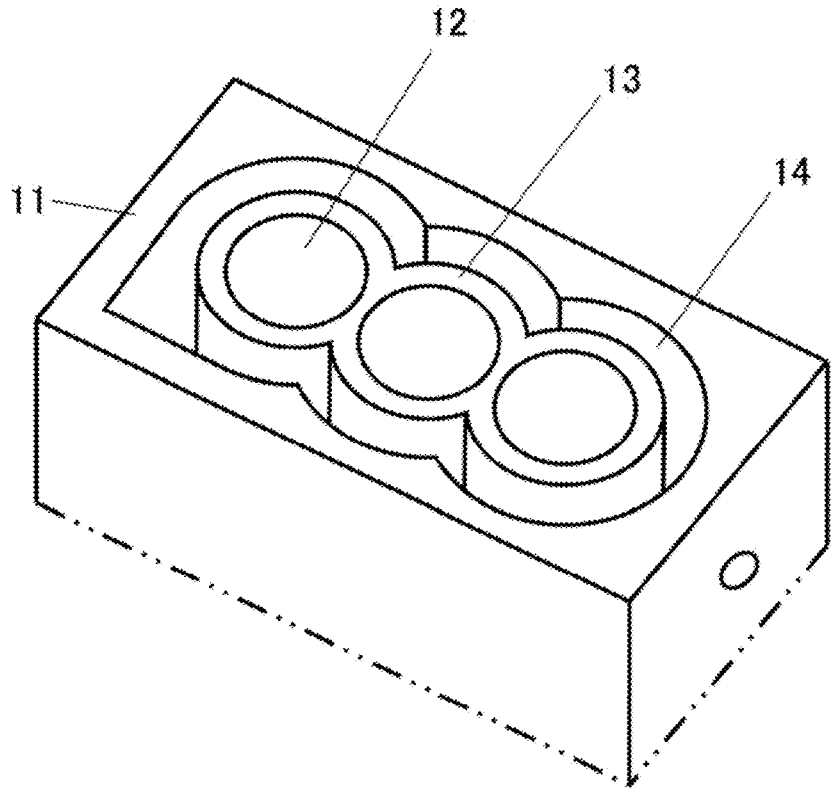
FIG. 3 is a perspective view illustrating the cylinder block illustrated in FIG. 1.
Figure 4:
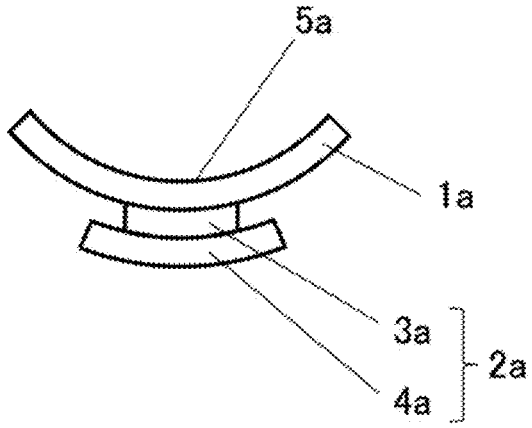
FIG. 4 is a schematic view illustrating the cylinder bore wall insulating member illustrated in FIG. 1.
Figure 4:
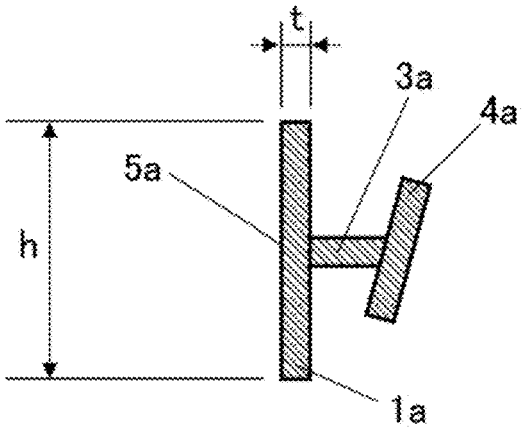
Figure 4:
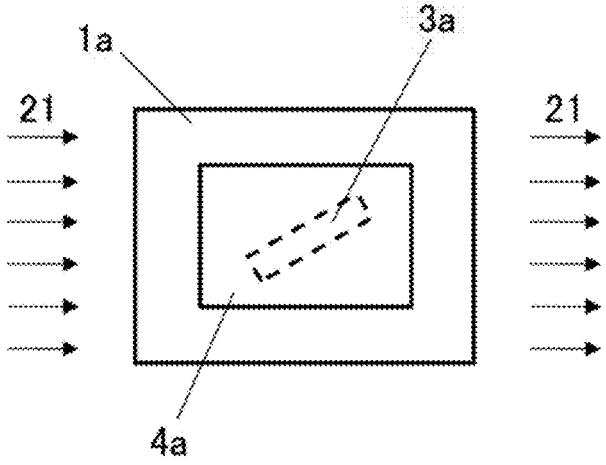

A cylinder bore wall insulating member according to one embodiment of the invention and an internal combustion engine according to one embodiment of the invention are described below with reference to FIGS. 1 to 4. FIGS. 1 to 4 illustrate an example of the cylinder bore wall insulating member according to one embodiment of the invention and a cylinder block in which the cylinder bore wall insulating member according to one embodiment of the invention is disposed. FIG. 1 is a schematic plan view illustrating a state in which the cylinder bore wall insulating member according to one embodiment of the invention is disposed in the cylinder block. FIG. 2 is a cross-sectional view taken along the line x-x in FIG. 1. FIG. 3 is a perspective view illustrating the cylinder block illustrated in FIG. 1. FIG. 4 is a schematic view illustrating the cylinder bore wall insulating member illustrated in FIG. 1 (wherein (4-1) is a plan view, (4-2) is a cross-sectional view taken along the line x-x in FIG. 1, and (4-3) is a side view)). Note that a plurality of insulating members may actually be disposed in the cylinder block illustrated in FIG. 1, but only one insulating member is illustrated in FIG. 1 for convenience. In FIG. 2, the area lower than the two-dot chain line is omitted.

As illustrated in FIGS. 1 and 3, an open-deck cylinder block 11 for an automotive internal combustion engine (in which an insulating member 1*a* is disposed) includes bores 12 and a groove-like coolant passage 14, a piston moving upward and downward in each bore 12, and a coolant flowing through the groove-like coolant passage 14. The boundary between the bores 12 and the groove-like coolant passage 14 is defined by a cylinder bore wall 13. The cylinder block 11 also includes a coolant inlet 15 for supplying the coolant to the groove-like coolant passage 11, and a coolant outlet 16 for discharging the coolant from the groove-like coolant passage 11.

As illustrated in FIG. 4, the insulating member 1*a* has a contact surface 5*a* that comes in contact with the cylinder bore wall 13. The contact surface 5*a* has a shape that is curved along the wall surface of the cylinder bore wall 13 so that the contact surface 5*a* can come in contact with the wall surface of the cylinder bore wall 13. A securing member 2*a* that includes a coupling section 3*a* and a wall contact section 4*a* is attached to the insulating member 1*a*. As illustrated in FIGS. 1 and 2, the insulating member 1*a* and the securing member 2*a* are disposed in the groove-like coolant passage 14 so that the contact surface 5*a* comes in contact with a wall surface 17 of the cylinder bore wall 13 that defines the groove-like coolant passage 14.

The internal combustion engine according to one embodiment of the invention includes a piston, a cylinder head, a head gasket, and the like in addition to the cylinder block, the insulating member, and the securing member.

The cylinder bore wall insulating member according to one embodiment of the invention is characterized by having the contact surface that comes in contact with the wall surface of the cylinder bore wall that forms the cylinder block of the internal combustion engine and defines the groove-like coolant passage.

The cylinder bore wall insulating member according to one embodiment of the invention covers the wall surface of the cylinder bore wall that defines the groove-like coolant passage with the contact surface that comes in contact with the wall surface of the cylinder bore wall that defines the groove-like coolant passage. The cylinder bore wall insulating member according to one embodiment of the invention thus prevents a situation in which the coolant comes in direct contact with the wall surface of the cylinder bore wall that defines the groove-like coolant passage.

The shape of the contact surface of the cylinder bore wall insulating member according to one embodiment of the invention that comes in contact with the wall surface of the cylinder bore wall that defines the groove-like coolant passage is appropriately adjusted corresponding to each cylinder block so that the contact surface has a shape that coincides with the shape of the wall surface of the cylinder bore wall that defines the groove-like coolant passage.

The cylinder bore wall insulating member according to one embodiment of the invention may be formed of a nylon resin, an elastomer, a rubber material (e.g., ethylene-propylene-diene rubber (EPDM), or nitrile-butadiene rubber (NBR)), or the like taking account of long-life coolant resistance (LLC resistance) and heat resistance. It is preferable to use a rubber material such as EPDM or NBR as the material for forming the insulating member since such a rubber material exhibits excellent elasticity and adhesion as compared with a nylon resin, and exhibits excellent heat resistance as compared with an elastomer.

The thickness (indicated by t in FIG. 4) of the cylinder bore wall insulating member according to one embodiment of the invention is appropriately selected taking account of the width of the groove-like coolant passage, the material that forms the insulating member, the estimated service period, the service conditions, and the like.

The cylinder bore wall insulating member according to one embodiment of the invention is disposed in the groove-like coolant passage so that the coolant does not come in contact with a lower area of the cylinder bore wall that defines the groove-like coolant passage. The shape, the arrangement, the arrangement position, the number, and the like of the cylinder bore wall insulating member(s) according to one embodiment of the invention are appropriately selected so that the cylinder bore wall has the desired temperature distribution.

The cylinder bore wall insulating member according to one embodiment of the invention may be used within the temperature range of −40 to 200° C. It is preferable that the cylinder bore wall insulating member according to one embodiment of the invention can endure a temperature of 120° C. or more, and particularly preferably 150° C. or more. The cylinder bore wall insulating member according to one embodiment of the invention is also required to exhibit LLC resistance.

The cylinder bore wall insulating member according to one embodiment of the invention may include a reinforcing material that is provided inside the insulating member or on the back surface opposite to the contact surface so that the shape of the insulating member can be maintained.

The cylinder bore wall insulating member according to one embodiment of the invention is secured using the securing member so that the contact surface comes in contact with the cylinder bore wall. In the example illustrated in FIGS. 1, 2, and 4, the insulating member 1*a* is secured using the securing member 2*a*. The securing member 2*a* includes the coupling section 3*a* and the wall contact section 4*a*. The wall contact section 4*a* comes in contact with a wall surface 18 of the groove-like coolant passage 14 opposite to the cylinder bore wall 13. Therefore, the contact surface of the wall contact section 4*a* is shaped to be fitted to the wall surface 18. The coupling section 3*a* couples the insulating member 1*a* and the wall contact section 4*a*. It is preferable that the coupling section 3*a* be tilted upward relative to a flow direction 21 of the coolant (see (4-3) in FIG. 4) so that a force that presses the insulating member 1*a* and the wall contact section 4*a* against the bottom of the groove-like coolant passage 14 is applied to the insulating member 1*a* and the wall contact section 4*a* due to the flow of the coolant, and the insulating member 1*a* is pressed against and secured on the cylinder bore wall 13. Note that the coupling section 3*a* is outlined by the dotted line in (4-3) in FIG. 4.

Figure 5:
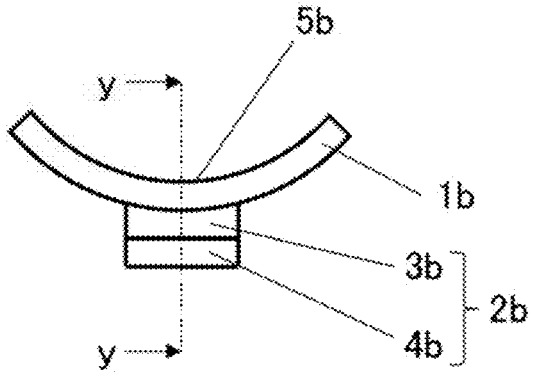
FIG. 5 is a schematic view illustrating another example of the cylinder bore wall insulating member according to one embodiment of the invention and a securing member.
Figure 5:
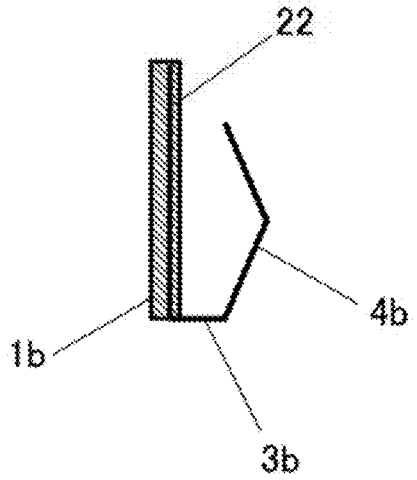

The securing member used to secure the cylinder bore wall insulating member according to one embodiment of the invention is not limited to that illustrated in FIGS. 1, 2, and 4. As illustrated in FIG. 5, the securing member may include a coupling section 3*b*, a wall contact section 4*b*, and an embedded section 22, for example. FIG. 5 is a schematic view illustrating another example of the cylinder bore wall insulating member according to one embodiment of the invention and the securing member, wherein (5-1) is a plan view illustrating the securing member, and (5-2) is a cross-sectional view taken along the line y-y in (5-1). The embedded section 22 is embedded in an insulating member 1*b*. The insulating member 1*b* is pressed against and secured on the cylinder bore wall due to a spring biasing force caused by the coupling section 3*b*, the wall contact section 4*b*, and the embedded section 22.

Note that the securing member is not limited to the above examples as long as the insulating member can be secured on the cylinder bore wall so that the contact surface of the insulating member comes in contact with the wall surface of the cylinder bore wall.

The insulating member may be bonded to the wall surface of the cylinder bore wall using an adhesive that exhibits heat resistance and LLC resistance (preferably an adhesive that exhibits low adhesion at room temperature (e.g., about 25° C.) in the absence of moisture, but exhibits high adhesion at a high temperature (e.g., about 80 to 100° C.) or in the presence of moisture).

The overall shape of the cylinder bore wall insulating member according to one embodiment of the invention and the shape of the securing member are not particularly limited as long as the flow of the coolant in the groove-like coolant passage is not hindered.

The internal combustion engine according to one embodiment of the invention is characterized by including the cylinder bore wall insulating member according to one embodiment of the invention (i.e., a cylinder bore wall insulating member that has a contact surface that comes in contact with a wall surface of a cylinder bore wall that forms a cylinder block of the internal combustion engine and defines a groove-like coolant passage) that is disposed so that the contact surface comes in contact with the wall surface of the cylinder bore wall that defines the groove-like coolant passage.

Figure 6:
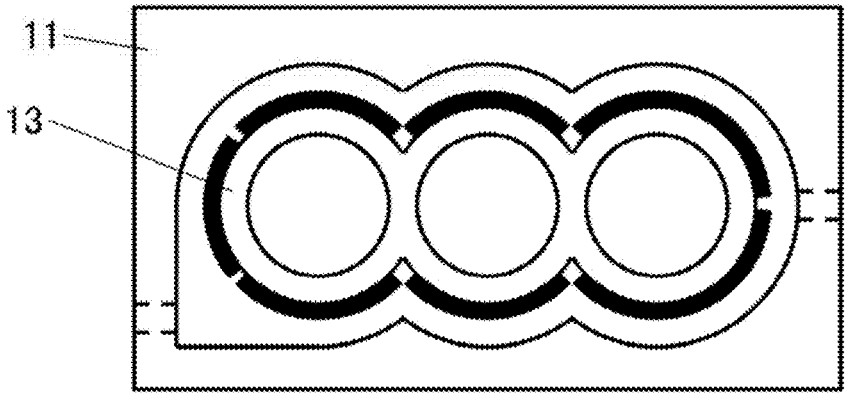
FIG. 6 is a view illustrating the installation position of an insulating member (1).
Figure 7:
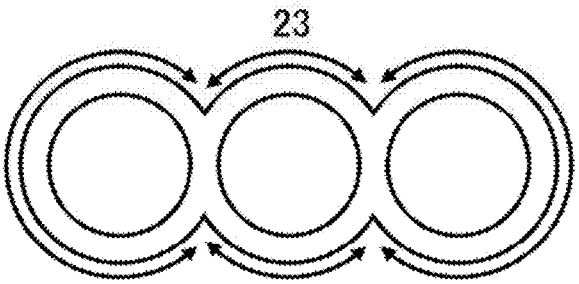
FIG. 7 is a view illustrating the circumferential direction (23) of a cylinder bore wall.
Figure 7:
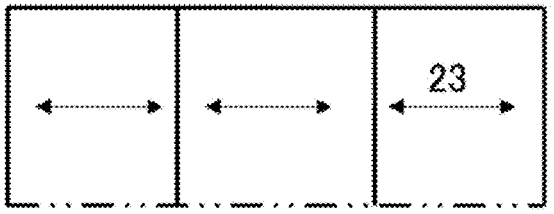

In the internal combustion engine according to one embodiment of the invention, the entire cylinder bore wall in the circumferential direction may be covered with the cylinder bore wall insulating member according to one embodiment of the invention. Note that the entire cylinder bore wall in the circumferential direction need not necessarily be covered with the cylinder bore wall insulating member according to one embodiment of the invention (see FIG. 6) taking account of workability when disposing the cylinder bore wall insulating member according to one embodiment of the invention, deformation determined by the coefficient of thermal expansion, cost-effectiveness, the heat insulation effect on the downstream side of the installation position of the insulating member due to stagnation of the flow of the coolant, and the like. In FIG. 6, the black-out area indicates the installation position of the insulating member. The term "circumferential direction" used herein in connection with the cylinder bore wall (see 23 in FIG. 7) refers to a direction that extends along the cylinder bore wall 13 (i.e., a direction that corresponds to the transverse direction when the cylinder bore wall 13 is viewed from the side). Note that (7-1) in FIG. 7 is a plan view illustrating only the cylinder bore wall 13, and (7-2) in FIG. 7 is a front view illustrating only the cylinder bore wall 13.

The cylinder bore wall insulating member according to one embodiment of the invention is disposed in the internal combustion engine according to one embodiment of the invention so that the upper end of the cylinder bore wall insulating member in the vertical direction is positioned lower than the position that is lower than the upper end of the groove-like coolant passage by ⅓rd of the length from the upper end to the lower end of the groove-like coolant passage. In FIG. 2, the position that is lower than the upper end of the groove-like coolant passage by ⅓rd of the length from the upper end to the lower end of the groove-like coolant passage refers to the position that is lower than an upper end 131 of the groove-like coolant passage by ⅓rd of the length from the upper end 131 to a lower end 132 of the groove-like coolant passage. It is preferable that the position of the lower end of the cylinder bore wall insulating member in the vertical direction coincide with the position of the lower end 132 of the groove-like coolant passage. Note that the lower end of the cylinder bore wall insulating member in the vertical direction may be positioned higher than the lower end 132 of the groove-like coolant passage taking account of the production of the cylinder bore wall insulating member, the shape of the groove-like coolant passage, and the like as long as the advantageous effects of the invention are not impaired.

An internal combustion engine is normally configured so that a lower area of the cylinder bore wall has a low temperature, and is easily cooled with the coolant as compared with an upper area of the cylinder bore wall where the fuel explodes. Therefore, a large difference in temperature occurs between the upper area and the lower area of the cylinder bore wall.

Since the internal combustion engine according to one embodiment of the invention in which the cylinder bore wall insulating member according to one embodiment of the invention is disposed can prevent a situation in which the coolant comes in direct contact with the cylinder bore wall, it is possible to prevent a situation in which the temperature of the lower area of the cylinder bore wall becomes too low as compared with the temperature of the upper area of the cylinder bore wall.

The invention is further described below by way of examples. Note that the invention is not limited to the following examples.

EXAMPLES

Example 1

A cylinder bore wall insulating member having the shape illustrated in FIGS. 1, 2, and 4 was produced. The specification of the insulating member is shown below. A cylinder block (provided with an observation window) having the shape illustrated in FIG. 3 and used for an experimental three-cylinder internal combustion engine was provided. The specification of the internal combustion engine is shown below. The insulating member was disposed in the groove-like coolant passage formed around the cylinder bore wall of the cylinder block.

A coolant (temperature: 20 to 40° C.) was passed through the groove-like coolant passage.

The behavior of the insulating member was continuously observed through the observation window of the cylinder block to determine adhesion of the insulating member to the wall surface of the cylinder bore wall defining the groove-like coolant passage. It was confirmed that the insulating member adhered to (i.e., was not separated from) the wall surface of the cylinder bore wall defining the groove-like coolant passage.

Insulating Member

Material: ethylene-propylene-diene copolymer rubber

Thickness (t) of insulating member 1*a:* 6.4 mm

Height (h) of insulating member 1*a:* 50 mm

Experimental Internal Combustion Engine

Width of groove-like coolant passage: 8.4 mm

Height of groove-like coolant passage (height in vertical direction): 90 mm

Installation position of insulating member: The lower end of the insulating member was positioned higher than the lower end of the groove-like coolant passage by 5 mm.

Temperature of coolant supplied: 20 to 40° C.

Computational Fluid Dynamics Analysis Results

Figure 8:
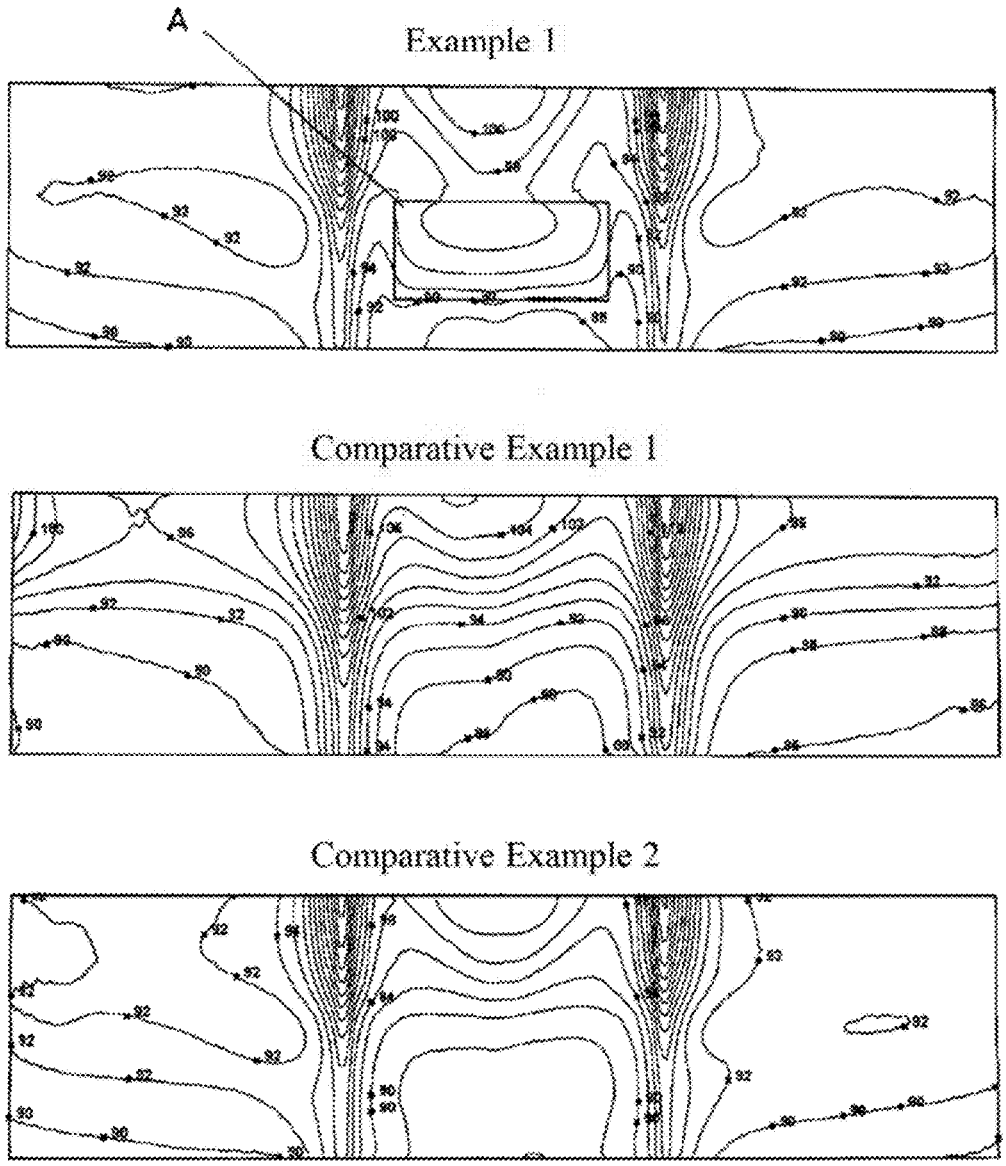
FIG. 8 is a view showing computational fluid dynamics analysis results obtained in Example 1 and Comparative Examples 1 and 2.

After confirming adhesion to the wall surface and the like, a known computational fluid dynamics analysis was performed in a state in which the flow of the coolant was stable. The results are shown in FIG. 8. In FIG. 8, the temperature distribution at the center indicates the temperature distribution of the cylinder bore wall of the center cylinder, and the temperature distribution on each side indicates the temperature distribution of the cylinder bore wall of each cylinder adjacent to the center cylinder. In FIG. 8, the sign A (Example 1) indicates the area in which the insulating member was provided.

Comparative Example 1

Operations were performed in the same manner as in Example 1, except that the insulating member was not disposed. The computational fluid dynamics analysis results are shown in FIG. 8.

Comparative Example 2

Operations were performed in the same manner as in Example 1, except that the flexible lip member (spacer member) disclosed in JP-A-2008-31939 was used instead of the insulating member. The computational fluid dynamics analysis results are shown in FIG. 8. In Comparative Example 2, the amount of the coolant was limited in the area in which the insulating member was disposed in Example 1.

As is clear from the results shown in FIG. 8, the temperature of the wall surface with which the insulating member came in contact was higher in Example 1 by 6 to 8° C. as compared with Comparative Examples 1 and 2. In Example 1, the wall surface of the cylinder bore wall defining the groove-like coolant passage showed a difference in temperature of 5° C. in the vertical direction (i.e., an almost uniform temperature distribution was obtained).

INDUSTRIAL APPLICABILITY

According to the embodiments of the invention, since the difference in deformation between the upper area and the lower area of the cylinder bore wall of an internal combustion engine can be reduced (i.e., friction of a piston can be reduced), a fuel-efficient internal combustion engine can be provided.

REFERENCE SIGNS LIST

1, 1*a*, 1*b*: Insulating member
2*a*, 2*b*: Securing member
3*a*, 3*b*: Coupling section
4*a*, 4*b*: Wall contact section
5*a*, 5*b*: Contact surface
11: Cylinder block
12: Bore
13: Cylinder bore wall
14: Groove-like coolant passage
15: Coolant inlet
16: Coolant outlet
17: Wall surface of cylinder bore wall 13 that defines groove-like coolant passage 14
18: Wall surface of groove-like coolant passage 14 opposite to cylinder bore wall 13
21: Coolant flow direction
22: Embedded section
23: Circumferential direction of cylinder bore wall
131: Upper end of groove-like coolant passage
132: Lower end of groove-like coolant passage

What is claimed is:

1. A cylinder bore wall insulating member, comprising:

an outer perimeter circumscribing an area within and having a contact surface that comes in contact with a wall surface of a cylinder bore wall that forms a cylinder block of an internal combustion engine and defines a groove-like coolant passage, and thereby covers the wall surface of the cylinder bore wall across the entirety of the area the cylinder wall insulating member, the contact surface being formed of an elastomer, a reinforcing material being provided inside the insulating member or on a back surface of the insulating member opposite to the contact surface, the insulating member being pressed against and secured on the cylinder bore wall using a securing member that includes a non-insulating wall contact section, said wall contact section having a height in an axial direction of the cylinder bore smaller than a height in the axial direction of the insulating member;

the contact surface of the insulating member covering only a wall surface of the groove-like coolant passage that is situated on a side of the cylinder bore wall, and wherein the wall contact section is configured to contact a wall surface of the groove-like coolant passage that is situated opposite to the cylinder bore wall only at a region having a depth in the axial direction between upper and lower ends of said insulating member.

2. The cylinder bore wall insulating member according to claim 1, the insulating member being pressed against the cylinder bore wall due to a spring biasing force.

3. The cylinder bore wall insulating member according to claim 1, wherein the cylinder bore wall insulating member is shaped such that a flow of coolant in the groove-like cooling passage is unhindered.

4. The cylinder bore wall insulating member according to claim 3, wherein a thickness of the cylinder bore wall insulating member is sized such that a flow of coolant in the groove-like cooling passage is unhindered.

5. An internal combustion engine, comprising:

a cylinder bore wall insulating member that has a contact surface that comes in contact with a wall surface of a cylinder bore wall that forms a cylinder block of the internal combustion engine and defines a groove-like coolant passage, the cylinder bore wall insulating member being disposed so that the contact surface comes in contact with the wall surface of the cylinder bore wall that defines the groove-like coolant passage, the contact surface being formed of an elastomer, a reinforcing material being provided inside the insulating member or on a back surface of the insulating member opposite to the contact surface, the insulating member being pressed against and secured on the cylinder bore wall using a securing member that includes a non-insulating wall contact section, said wall contact section having a height in an axial direction of the cylinder bore smaller than a height in the axial direction of the insulating member, and wherein the wall contact section is configured to contact a wall surface of the groove-like coolant passage that is situated opposite to the cylinder bore wall only at a region having a depth in the axial direction between upper and lower ends of said insulating member.

6. The internal combustion engine according to claim 5, wherein entirety of the cylinder bore wall in a circumferential direction is covered with the cylinder bore wall insulating member.

7. The internal combustion engine according to claim 6, wherein the cylinder bore wall insulating member is pressed against the cylinder bore wall due to a spring biasing force.

8. An automobile comprising the internal combustion engine according to claim 7.

9. An automobile comprising the internal combustion engine according to claim 6.

10. The internal combustion engine according to claim 5, wherein part of the cylinder bore wall in a circumferential direction is not covered with the cylinder bore wall insulating member.

11. The internal combustion engine according to claim 10, wherein the cylinder bore wall insulating member is pressed against the cylinder bore wall due to a spring biasing force.

12. An automobile comprising the internal combustion engine according to claim 11.

13. An automobile comprising the internal combustion engine according to claim 10.

14. The internal combustion engine according to claim 5, wherein an upper end of the cylinder bore wall insulating member in a vertical direction is positioned lower than a position that is lower than an upper end of the groove-like coolant passage by ⅓rd of a length from the upper end to a lower end of the groove-like coolant passage.

15. The internal combustion engine according to claim 5, wherein the cylinder bore wall insulating member is pressed against the cylinder bore wall due to a spring biasing force.

16. An automobile comprising the internal combustion engine according to claim 15.

17. An automobile comprising the internal combustion engine according to claim 5.

* * * * *